US006022278A

United States Patent [19]

Vela

[11] Patent Number: 6,022,278

[45] Date of Patent: Feb. 8, 2000

[54] GOLF CLUB, GRIP, AND CLUB POSITIONING METHOD

[76] Inventor: Al J. Vela, 1441 E. Comstock Ave., Glendora, Calif. 91741

[21] Appl. No.: 08/984,467

[22] Filed: Dec. 3, 1997

[51] Int. Cl.[7] ..... A63B 69/36

[52] U.S. Cl. ..... 473/201; 473/238; 473/409

[58] Field of Search ..... 473/409, 238, 473/200, 201, 300

[56] References Cited

U.S. PATENT DOCUMENTS

| | | | |
|---|---|---|---|
| Re. 21,439 | 4/1940 | Link . | |
| D. 30,708 | 5/1899 | Griffith . | |
| D. 240,367 | 6/1976 | Cope . | |
| D. 341,178 | 11/1993 | Rice et al. . | |
| D. 365,131 | 12/1995 | Edwards et al. . | |
| 1,587,082 | 6/1926 | Mattern | 473/201 |
| 1,638,454 | 8/1927 | Papin . | |
| 1,664,257 | 3/1928 | McCullough . | |
| 2,865,635 | 12/1958 | Jessen | 473/200 X |
| 3,848,874 | 11/1974 | Elkins | 473/409 |
| 5,158,297 | 10/1992 | Johnson | 473/238 |
| 5,215,307 | 6/1993 | Huffman . | |
| 5,299,802 | 4/1994 | Bouchet-Lassale . | |
| 5,348,303 | 9/1994 | Swissheim | 473/201 |
| 5,398,930 | 3/1995 | Gibson . | |
| 5,427,376 | 6/1995 | Cummings et al. | 473/238 X |
| 5,480,146 | 1/1996 | Comer . | |
| 5,588,921 | 12/1996 | Parsick . | |

OTHER PUBLICATIONS

Advertisement from Kerdad, Inc. of Alamo, California for Golf Swinger (unknown date).

Advertisement from unknown source for Special Training Grips (unknown date).

Advertisement from Matzie Golf Co., Inc., of El Segundo, California for Assist Swing Trainer (unknown date).

*Primary Examiner*—George J. Marlo

*Attorney, Agent, or Firm*—Workman, Nydegger & Seeley

[57] ABSTRACT

Indicia attached to a golf club grip or shaft indicates the proper positioning of the golf club and hands during gripping of the golf club and during the golf swing. The indicia may also warn the golfer that the golf club is incorrectly positioned. The indicia may be attached to an existing golf grip or shaft, or integrally formed with the golf grip or shaft. Additionally, the indicia may be permanently or removably attached to the golf grip or shaft. The indicia, for example, may include a first line and a second line which are visible to the golfer during a golf swing to indicate that the golf club is in the desired position, but if the first or second lines are not visible, that indicates the golf club is not in the desired position. Hand positioning indicia having a generally V-shaped configuration extends between the first and second lines, and the first and second lines are preferably spaced at least about 120° apart when viewed from the end of the grip and the lines are preferably generally parallel to a longitudinal axis of the grip. More preferably, the first line is positioned on one side of the grip generally between about 0° and about 30° above a horizontal axis when viewed from the end of the grip and the second line is positioned on the other side of the grip generally between about 0° and about 30° above the horizontal axis.

27 Claims, 5 Drawing Sheets

GOLF CLUB, GRIP, AND CLUB POSITIONING METHOD

BACKGROUND

This invention relates in general to golf clubs and, in particular, to a device which allows golf clubs to be correctly positioned during a golf swing.

In the game of golf, a golfer holds the handle or grip of the golf club and swings the golf club so that the golf club head hits the golf ball and propels the ball towards the hole. The game of golf has been played for hundreds of years and has produced numerous technical advancements in many areas of the game, including the golf ball, golf course and golf clubs. These technical advances have lowered the scores of many golfers and have added to the enjoyment of the game.

One area of particular importance is the golf club grip, which the golfer holds while swinging the golf club. A conventional golf grip includes a strip of material, such as leather, wrapped around the handle portion of the golf shaft. Another conventional golf grip includes a tubular member or sleeve that is attached to the handle of the golf club. These conventional golf grips often include striations, dimples and other types of indentations to allow the golfer to more securely hold the golf club during the swing. These known golf grips also help prevent slipping of the golf club in the hands of the golfer during the swing.

Another area of particular interest is the correct positioning of the golf club during the golf swing. Fundamentally, the hands, wrists, arms, body and legs of the golfer must move such that the golf club is correctly positioned during each portion of the golf swing. Without the correct positioning of the golf club during the swing, it is very difficult to strike the golf ball in the desired manner and it is very difficult to develop a repeatable, consistent golf swing. That is, the club must be correctly positioned relative to the golfer and the golf ball during the golf swing; including during the back swing, approach towards the golf ball, impact with the golf ball, and follow-through after striking the golf ball.

There are a wide variety of golfing aids which are conventionally used to improve a golfer's grip of the golf club. For example, U.S. Pat. No. 5,480,146 issued to Comer discloses a golf grip with recesses to ensure proper positioning of the hands of the golfer. In particular, a. plurality of separate recesses are located on the central portion of the grip, a plurality of separate recesses are formed on the upper portion of the grip, and another plurality of separate recesses are formed on the lower portion of the grip. These recesses are used to position the golfer's hands around the golf grip. Disadvantageously, the recesses increase the cost of the grip and the recesses are not correctly positioned for golfers of different sizes and abilities. Additionally, the golf grip disclosed in the Comer patent does not teach proper orientation of the golf club during the golf swing. Further, these plurality of recesses significantly alter the configuration of the grip and it is not usable during competition according to the rules of the United States Golf Association ("USGA"). Thus, the golf grip must be removed and a different grip installed before the golf club can be used in competition.

Another conventional golf grip is disclosed in U.S. Pat. No. 5,427,376 issued to Cummings, et al. The Cummings patent discloses a golf grip with markings to indicate where the thumbs and fingers of a golfer are to be located, and other markings to indicate regions of the grip which should not be contacted by the hands of the golfer. The Cummings patent, while disclosing markings which position the hands about the golf grip, does not aid in the proper positioning of the golf club during the golf swing. Disadvantageously, even if the hands of the golfer are correctly positioned about the grip, the golfer may still have difficulty in correctly hitting the golf ball because the golf club is not correctly positioned during the swing.

Therefore, there is a need for a device that is simple and easy to manufacture, and which allows a golfer to quickly and easily position the golf club in the desired location during the golf swing.

SUMMARY

The present invention comprises indicia for positioning a golf club in the correct position during the golf swing.

One aspect of the invention includes indicia or markings attached to the outer surface of the golf grip to allow the golfer to correctly position the golf club during the golf swing. The indicia preferably includes one or more symbols which the golfer can see and use to determine if the golf club is in the correct position, but the indicia may also warn the golfer that the golf club is not in the correct position.

Another aspect of the invention is the indicia may be releasably attached to the grip or the shaft of the golf club. For example, tape or a releasable adhesive may allow the indicia to be readily attached or removed from the grip or shaft. Thus, a golfer can attach the indicia to the golf club to practice his or her golf swing, and then remove the indicia when desired. On the other hand, the indicia may be permanently attached to the golf grip or shaft. For example, a portion of the grip or shaft may be constructed from different materials or materials of different colors than the other portions of the grip or shaft, respectively.

Yet another aspect of the invention is the indicia allows the golfer to correctly position the golf club during the golf swing without any significant modification to a conventional golf grip or shaft. Advantageously, because the indicia does not significantly change the shape or configuration of the grip or shaft, applicant believes it can be used during competition according to the rules of the USGA.

In another aspect of the present invention, the indicia can be used with golfers of various skill levels. For example, the indicia can be used while instructing a beginning golfer how to correctly position the golf club during the golf swing. Proper positioning of the golf club is very important because, if the golfer consistently positions the golf club in the proper location during the golf swing, this results in a more consistent execution of an effective golf swing. This also improves the ability and likelihood of an effective golf shot. The golf grip can also be used by accomplished players to correct flaws in their golf game. Advantageously, the golf grip can be used while practicing and during competition.

In still another aspect of the invention, the golf grip is equally applicable to right-handed and left-handed golfers without significant modification.

In a further aspect of the present invention, the indicia can be used with different types of golf club shafts, including shafts constructed from steel, graphite, and composite materials. The indicia can also be used with different types of golf clubs, including woods, "metal woods," and irons. Thus, the indicia can be used with various types of shafts and types of golf clubs to provide a durable, reliable and cost-effective way to ensure the golf club is in the correct position during the swing.

Another aspect of the invention is the indicia is easy to install and simple to use. For example, the indicia may be attached to an existing golf club grip, and the indicia may be attached by the golfer, the manufacturer or others. Additionally, the indicia may be formed as part of the grip and then the grip may be attached to the golf club. Thus, the grip with the indicia may be used as a replacement grip or a new grip.

A still further aspect of the invention is the indicia is easy to attach to the golf club and simple to use. The indicia is positioned so that the golfer can look at the golf club during various portions of the swing to quickly and easily determine if the golf club is in the correct position. On the other hand, the indicia may be position such that the golfer can look at the golf club and see that the golf club is incorrectly positioned. Of course, the grip can include indicia that indicates the correct positioning of the golf club and indicia that indicates the golf club is incorrectly positioned.

In one embodiment, the present invention comprises a golf club grip including an elongated tubular body configured to be attached to the shaft of a golf club, the elongated body includes a longitudinal axis, and indicia is attached to the elongated body. The indicia indicates the correct positioning of the golf club during a golf swing.

In another embodiment, indicia is placed on the outer surface of the elongated body to indicate the correct positioning of the golf club during a golf swing. When the golfer looks at the indicia during various portions of the golf swing, the indicia indicates the position of the golf club.

In still another embodiment, indicia indicates the correct positioning of the golf club during a golf swing. The indicia includes a top surface configured to be engaged by the hands of a golfer and a bottom surface including an adhesive layer to attach the indicia to the golf club.

BRIEF DESCRIPTION OF THE DRAWINGS

These and other features of the present invention will now be described with reference to the drawings of preferred embodiments, which are intended to illustrate and not to limit the invention, in which:

FIG. 21 is another perspective view of the golf grip shown in FIG. 14, illustrating a golfer during the follow-through.

DETAILED DESCRIPTION OF THE PREFERRED EMBODIMENT

Figure 1:
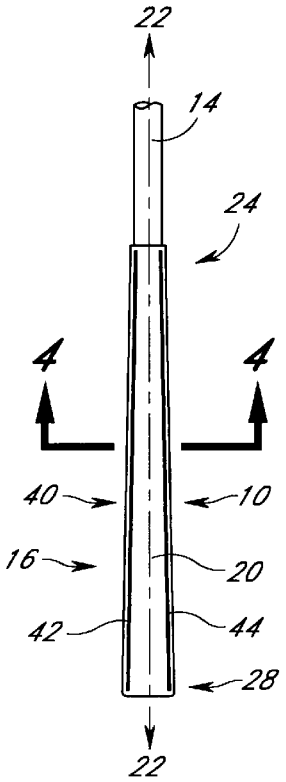
FIG. 1 is a top plan view of the golf grip of the present invention.

As seen in FIGS. 1–4, in a preferred embodiment of the invention, the golf grip 10 of the present invention is attached to the shaft 14 at the handle end 16 of a golf club 12. The golf grip 10 may comprise any known type of grip. For example, the golf grip 10 can be in the form of a leather strap spirally wound around the handle 16 of the golf club 12. This results in a spiral groove which enhances the grip of the golfer. It will be understood that other natural and synthetic materials may also be wrapped around the handle of the golf club to form the golf grip. Additionally, the golf grip 10 may be in the form of a tubular member or sleeve which is attached to the handle 16 of the golf club 12. As known in the art, the tubular sleeve may be constructed from a variety of natural and synthetic materials. Preferably the sleeve is constructed from a synthetic rubber material or other similar material which is slightly stretchable to allow the grip to be fitted over the handle 16 of the golf club 12. These grips are preferably constructed from an elastomeric material which cushions or absorbs a portion of the force when the golf club strikes a golf ball. Further, the grips are preferably constructed from a resilient material which rapidly returns to its original shape after a force is applied to the grip. As known in the art, the grip may include one or more holes, striations or dimples to help prevent slipping of the golf club in the hands of the golfer.

As shown in FIGS. 1–4, the grip 10 comprises a generally tubular or cylindrical body 20 which extends generally along a longitudinal axis 22. The longitudinal axis 22 of the grip 10 is preferably coincident with a longitudinal axis of the shaft 14 of the golf club 12. The tubular body 20 has a first end 24 with an opening (not shown) configured to receive the handle portion 16 of the shaft 14. The tubular body 20 also has a second end 28 which has a cap (not shown). The cap may be formed as part of the grip 10, or the cap may be subsequently attached to the grip or shaft 14 of the golf club 12. The cap preferably includes a small opening or aperture which extends through the cap and opens to the interior portion of the shaft 14.

The grip 10 is preferably about 12 inches (30 cm) in length, but it can be longer or shorter depending, for example, upon the length of the shaft 14, type of golf club or preference of the golfer. The first end 24 of the grip 10 preferably has a diameter of about ½ inch (1.2 cm) and the grip 10 is gradually tapered such the second end 28 has a diameter of about 1 inch (2.5 cm), but the grip may also be larger or smaller. For example, the grip 10 may be "oversized" with the first end 24 of the grip having a diameter of about ¾ inch (1.9 cm) and the second end 28 of the grip having a diameter of about 1 ¼ inch (3.2 cm). Additionally, the grip may not have a tapered surface, the grip may have other desired configurations, and the grip does not have to be constructed in accordance with the rules of the USGA.

Although not shown in the accompanying figures, the grip 10 may include striations, dimples or other types of indentations to allow the golfer to obtain a better hold or grasp of the golf club 12. The grip 10 may also include lines or grooves, and a textured, etched or slightly sticky surface to improve the hold of the golfer. Of course, the grip 10 may also be generally round and smooth.

Figure 4:
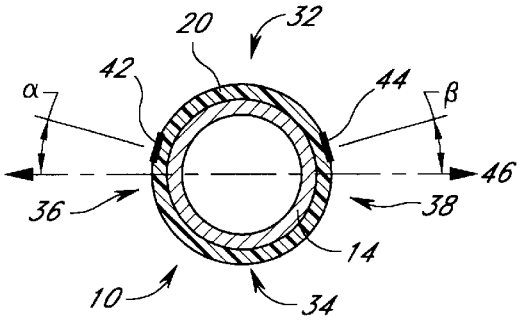
FIG. 4 is an enlarged cross-sectional end view along lines 4—4 of the golf grip shown in FIG. 1.

As best seen in FIG. 4, the grip 10 is generally divided into a front side 32 and a rear side 34. The front side 32 of the golf grip 10 is generally aligned with the golf club head and the rear side 34 is opposite the front side. As seen in the accompanying figures, the grip 10 also includes a left side 36 and a right side 38. The front side 32, rear side 34, left side 36 and right side 38 generally separate the grip into four different sections. When the golfer initially addresses the golf ball in a conventional position, the golfer sees the front surface 32 and the rear surface 34 faces the ground. The left and right sides 36 and 38 of the grip 10 are positioned on the left and right sides, respectively, of the golfer. Of course, the golf grip 10 may be positioned in any desired orientation, and this description is used for ease of reference in describing the present invention.

As seen in FIGS. 1–4, the golf grip 10 includes indicia 40 a first line 42 and a second line 44 which extend generally along the length of the grip. The lines 42 and 44 may, for example, be solid, dashed or dotted; and the lines may have any desired thickness. The lines 42 and 44 are preferably a different color from the other portions of the grip 10 so that the golfer can easily see the lines. For example, the golf grip 10 may be generally black while the lines are generally white. It will be understood the lines 42 and 44, for example, may also include different patterns and multiple lines to contrast the lines from other portions of the grip. Additionally, the lines 42 and 44 may extend the entire length of the grip 10 or only a portion of the grip. Further, the lines 42 and 44 may be textured, scored or striped to distinguish the lines from the other portions of the grip. Finally, the lines 42 and 44 may have different colors and/or patterns so that the golfer can distinguish one line from the other line.

As seen in FIG. 4, the lines 42 and 44 are attached to the front side 32 of the grip 10, at an angle of $\alpha$ and $\beta$, respectively, with respect to the horizontal axis 46. Preferably, the angles $\alpha$ and $\beta$ are between about 0° and 30° above the horizontal axis 46, and more preferably the angles $\alpha$ and $\beta$ are between about 0° and 20° above the horizontal axis. Most preferably the angles $\alpha$ and $\beta$ are between about 0° and 10° above the horizontal axis such that, as shown in FIG. 1, in the top view of the grip 10, the lines 42 and 44 are visible on the left and right edges of the grip. Of course, the angles $\alpha$ and $\beta$ may depend upon factors such as the thickness of the lines and the thickness of the grip.

Figure 2:
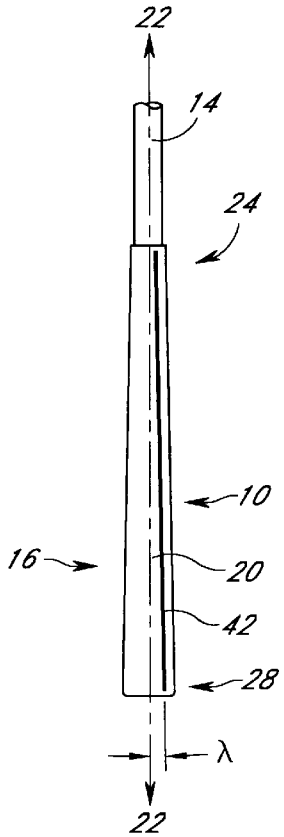
FIG. 2 is a left side view of the golf grip shown in FIG. 1.
Figure 3:
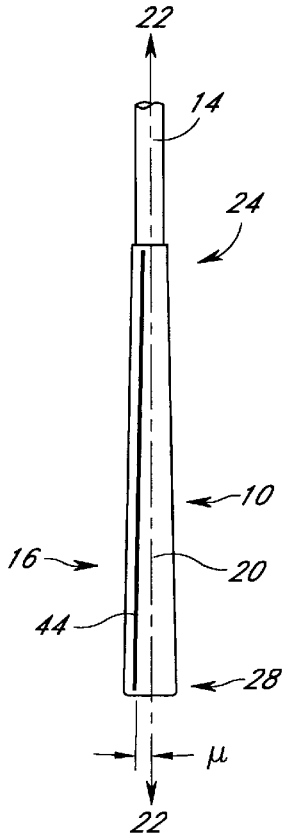
FIG. 3 is a right side view of the golf grip shown in FIG. 1.

As best seen in FIGS. 2 and 3, the lines 42 and 44 are not parallel with the longitudinal axis 22 of the grip 10 and, instead, the lines 42 and 44 are at an angle $\lambda$ and $\mu$, respectively, with respect to the longitudinal axis. The lines 42 and 44 are positioned at angles of $\lambda$ and $\mu$ so that the golfer can see a generally consistent portion of the lines along the left and right sides of the grip. The angles $\lambda$ and $\mu$ are preferably between about 0° and 10°, and more preferably between about 0° and 5°, but it will be appreciated that the angles may depend, for example, upon the size, shape and taper of the grip 10. The lines 42 and 44 are at angles $\lambda$ and $\mu$ respectively, because the outer surface of the grip is tapered. Of course, if the grip 10 is not tapered, the lines 42 and 44 may be parallel to the longitudinal axis 22.

Figure 9:
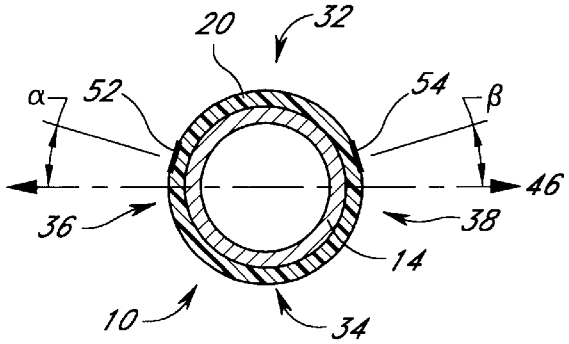
FIG. 9 is an end enlarged cross-sectional view along lines 9—9 of the golf grip shown in FIG. 6.
Figure 10:
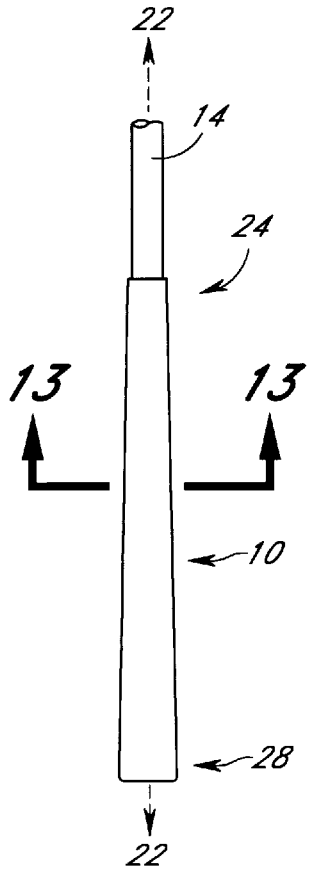
FIG. 10 is a top plan view of another embodiment of the golf club of the present invention.

As seen in FIGS. 6–9, in another preferred embodiment of the invention, indicia 50 including a left line 52, a right line 54, a first "V" 56 and a second "V" 58 are attached to the grip 10. The first "V" 56 and the second "V" 58 are preferably configured to be aligned with the "V" formed between the thumb and first finger of the golfer. As described above, the indicia 50 may, for example, have different thicknesses, colors and lengths. As best seen in FIG. 9, the lines 52 and 54 are located at an angle of $\alpha$ and $\beta$, respectively, above the horizontal axis 46, which generally divides the front surface 32 from the rear surface 34 of the grip 10. Preferably, angles $\alpha$ and $\beta$ are generally between about 0° and 20° from the horizontal axis 46, and more preferably between about 0° and 10° from the horizontal axis. The right and left lines 52 and 54, respectively, preferably have a length about 5 inches (12.7 cm) and a thickness of about 0.125 inches (0.3 cm). The first "V" is preferably located about 3.5 inches (9 cm) from the first end 24 of the grip 10 and the second "V" is preferably located about 6 inches (15 cm) from the first end 24 of the grip 10. A central portion 60 between the lines 52 and 54 may have a different color from the other portions of the grip 10, and the central portion preferably has the same color as the indicia 50.

Figure 11:
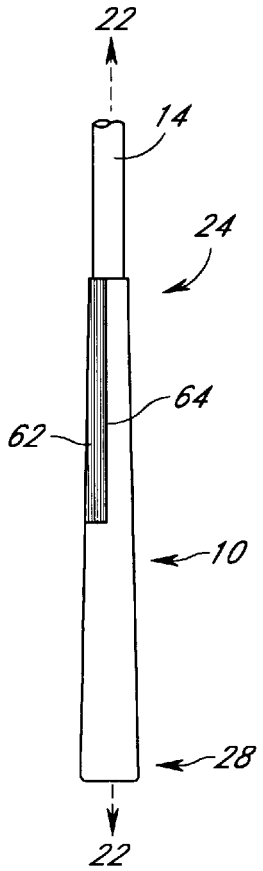
FIG. 11 is a left side view of the golf grip shown in FIG. 10.
Figure 12:
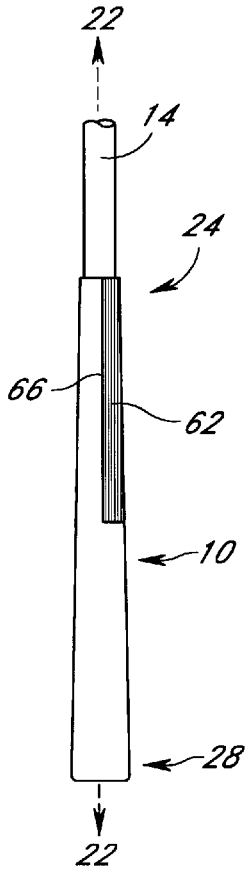
FIG. 12 is a right side view of the golf grip shown in FIG. 10.
Figure 13:
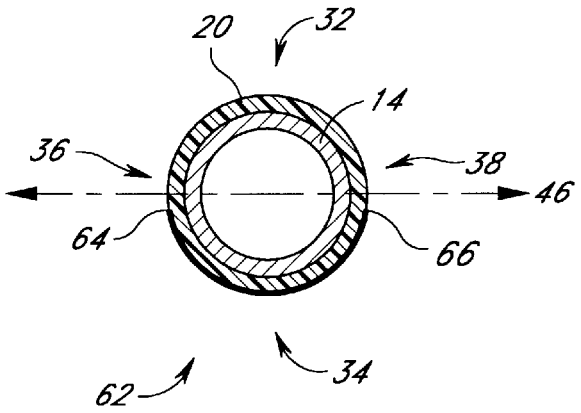
FIG. 13 is an enlarged cross-sectional end view along lines 13—13 of the golf grip shown in FIG. 10.
Figure 17:
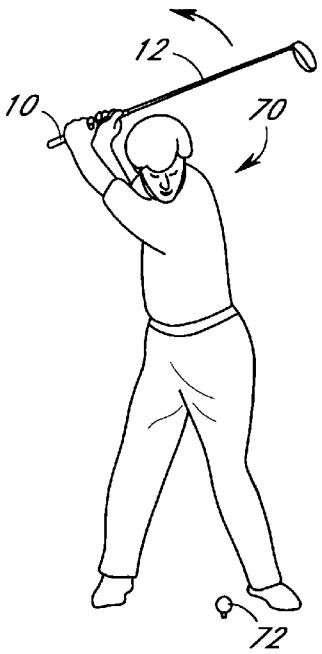
FIG. 17 is another perspective view of the golf grip shown in FIG. 14, illustrating a golfer during a portion of the swing towards the golf ball.

As seen in FIGS. 10–13, indicia 62 including a first line 64 and a second line 66 may be attached to the grip 10. As best seen in FIGS. 11–13, the indicia 62 is not attached to the front surface 32 of the grip 10. Instead, the indicia 62 is attached to the rear surfaces 34 of the grip 10 so that the indicia is not visible in the top view shown in FIG. 10. As best seen in FIG. 13, the lines 64 and 66 are located slightly below the horizontal axis 46. As best seen in FIGS. 11–13, the indicia 62 preferably extends about 3 inches (8 cm) from the first end 24 of the grip 10, and the portion of the rear surface 34 of the grip 10 between the lines 64 and 66 is preferably a different color from the remaining portion of the grip. The indicia 62 is preferably the color red and the remaining portions of the grip are preferably black, but any desired colors may be used.

The indicia 40, 50 and 62 advantageously may be attached to an existing golf grip. For example, the indicia 40, 50 and 62 may include an outer surface which may be gripped by the golfer, and an inner surface which includes an adhesive layer which attaches the indicia 40, 50 and 62 to the grip. The adhesive may permanently or removably attach the indicia to the grip. In addition, the indicia 40, 50 and 62 may be attached to the grip 10, for example, by painting, drawing, etching, dying or coloring the desired portion or portions of the grip 10. Further, the indicia 40, 50 and 62 may be attached to the grip 10 and then the grip may be attached to the golf club 12. Thus, the grip with the indicia 40, 50 and 62 may be used with a new grip or a replacement grip. In yet another embodiment, although not shown in the accompanying figures, the indicia 40, 50 and 62 may be attached to the shaft 14 of the golf club 12.

The indicia 40, 50 and 62 may also be incorporated as a portion of the grip instead of being subsequently attached to the grip. For example, the grip may be manufactured or constructed from different types of materials or materials with different colors to create the desired indicia 40, 50 and 62. Additionally, the indicia 40, 50 and 62 may be formed as part of an integral, one-piece golf grip 10.

Advantageously, the grip 10 may be used with any type of shaft 14, including, for example, shafts constructed from steel, graphite and composite materials. The grip 10 can also be used with any type of golf club 12, including woods, "metal woods" and irons. Thus, the grip 10 can be used in a wide variety of applications and circumstances. Further, the grip 10 can advantageously be used by both left-handed and right-handed golfers without significant modification.

In use, the golfer 70 holds the grip 10 attached to the golf club 12 in the desired manner and performs all or a portion of a practice golf swing. Advantageously, the grip 10 can be used while practicing and playing the game of golf. Although the following description refers to the embodiment of the present invention shown in FIGS. 1–4, it will be understood that any embodiment of the invention may be utilized.

Figure 5:
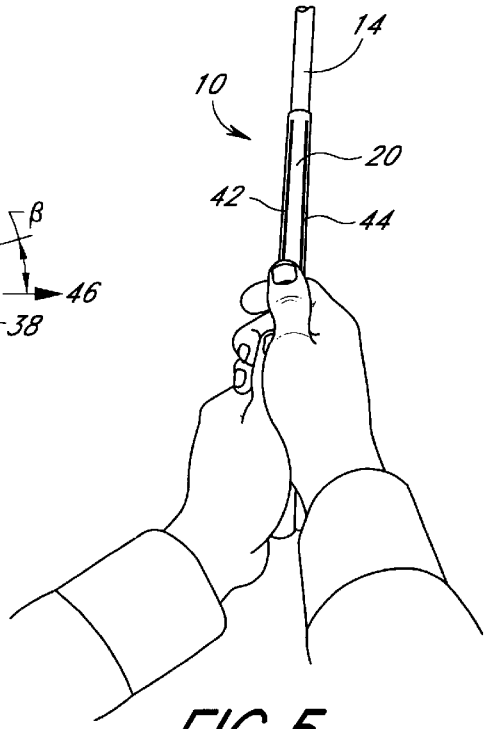
FIG. 5 is a top plan view of the golf grip shown in FIG. 1, illustrating a golfer holding the golf grip.
Figure 6:
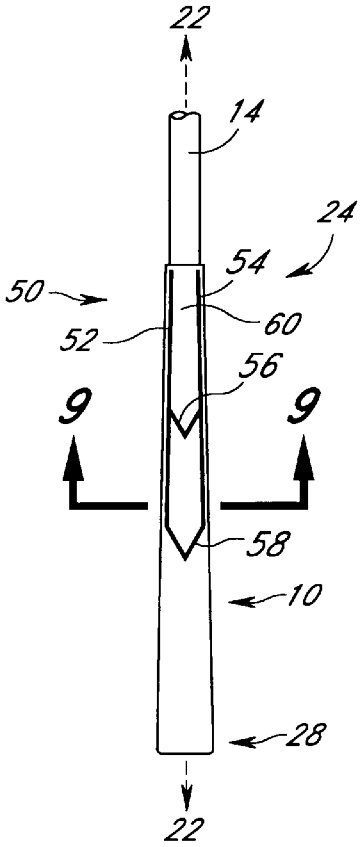
FIG. 6 is a top plan view of another embodiment of the golf grip of the present invention.
Figure 7:
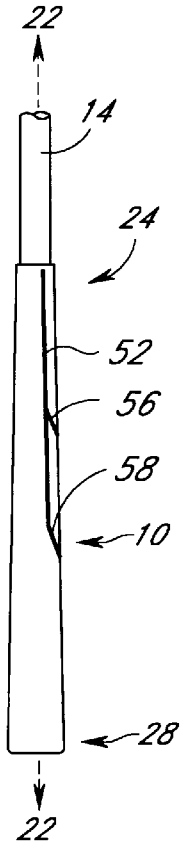
FIG. 7 is a left side view of the golf grip shown in FIG. 6.
Figure 8:
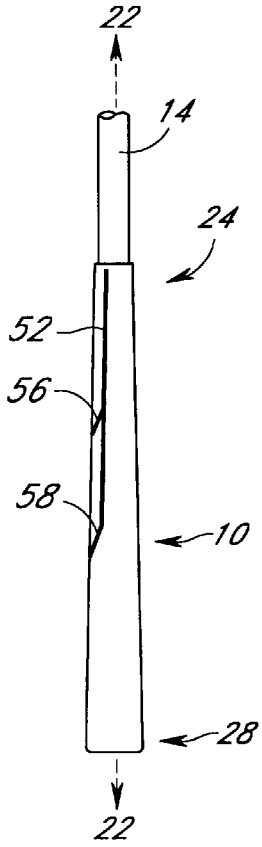
FIG. 8 is a right side view of the golf grip shown in FIG. 6.
Figure 16:
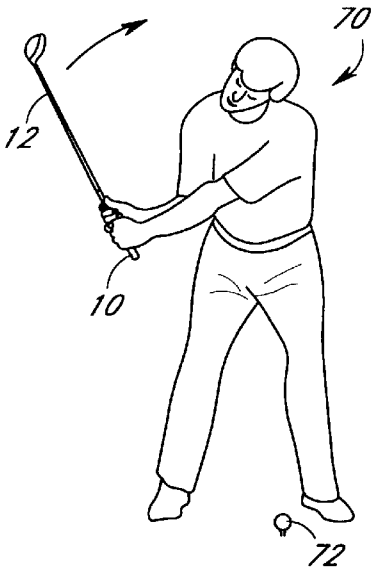
FIG. 16 is another perspective view of the golf grip shown in FIG. 14, illustrating a golfer during another portion of the back swing.
Figure 15:
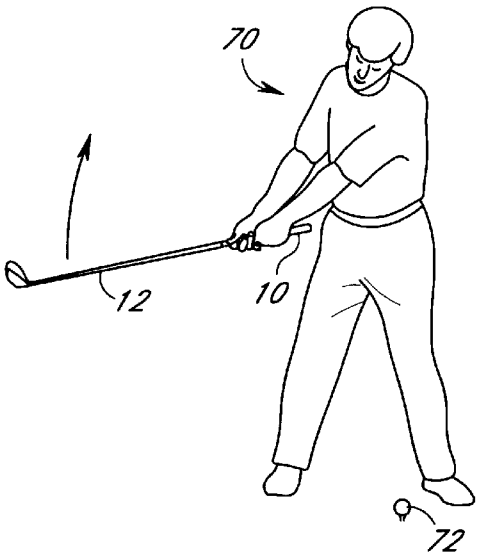
FIG. 15 is another perspective view of the golf grip shown in FIG. 14, illustrating a golfer during a portion of the back swing.
Figure 14:
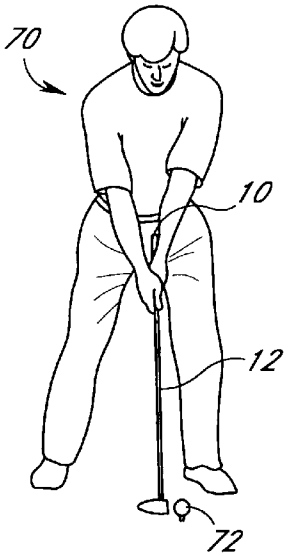
FIG. 14 is a perspective view of the golf grip of the present invention, illustrating a golfer addressing a golf ball.

As shown in FIG. 5, when the golfer 70 holds the grip 10 in a conventional manner, the golfer can see the indicia 40 comprising the first line 42 on the left side 36 of the grip 10 and the second line 44 on the right side 38 of the grip 10. Thus, when the golfer 70 addresses the golf ball 72 as shown in FIG. 14, the golfer can see the indicia 40 on both sides of the grip 10. As the golfer 70 begins a practice back swing, as illustrated in FIGS. 15 and 16, the golfer can look at the grip 10 and, if the golfer sees the indicia 40 on both sides of the grip, the golf club 12 is in the correct position. On the other hand, if the golfer does not see the indicia 40 on both sides of the grip 10, the golfer can quickly and easily determine that the golf club 12 has been moved out of the proper position. Thus, the golfer 70 can adjust the positioning of the golf club 12 such that the golfer can see the indicia 40 on both sides of the grip 10.

Figure 21:
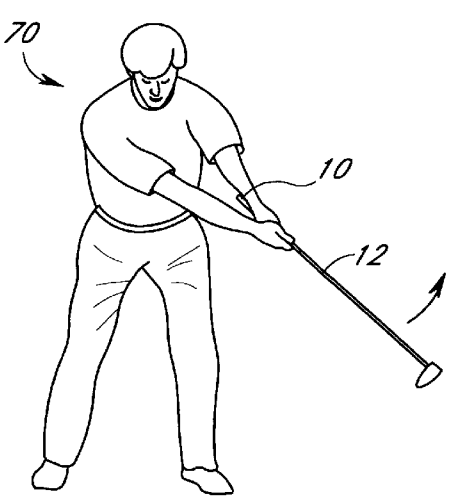
Figure 20:
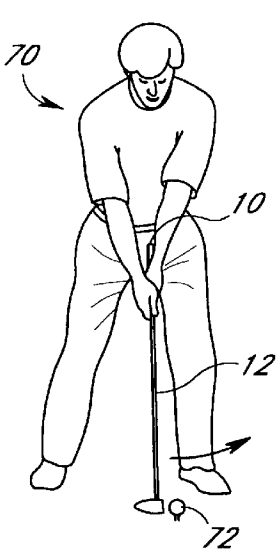
FIG. 20 is another perspective view of the golf grip shown in FIG. 14, illustrating a golfer proximate impact of the golf club with the golf ball.
Figure 19:
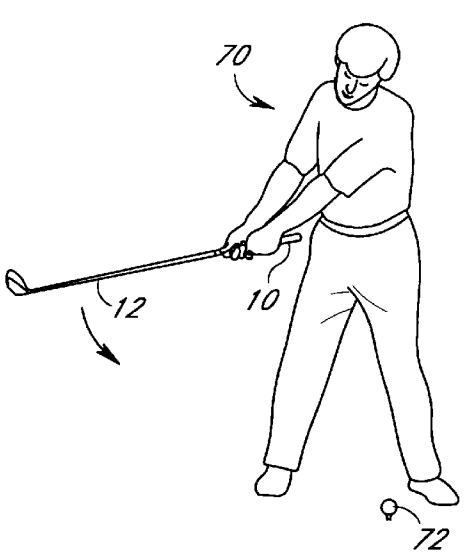
FIG. 19 is another perspective view of the golf grip shown in FIG. 14, illustrating a golfer during yet another portion of the swing towards the golf ball.
Figure 18:
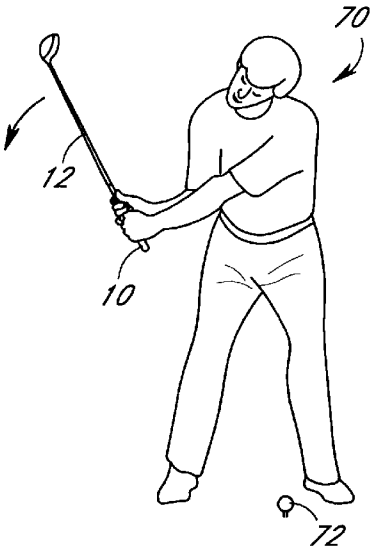
FIG. 18 is another perspective view of the golf grip shown in FIG. 14, illustrating a golfer during another portion of the swing towards the golf ball.

As seen in FIGS. 18 and 19, when the golfer 70 is swinging the golf club 12 towards the ball 72, the golfer can again look at the grip 10 to see if the golf club is in the correct position. If the golfer 70 cannot see the indicia 40 on both sides of the grip 10, the golfer can adjust the golf club 12 such that the club is in the correct position. As shown in FIGS. 20 and 21, the golfer can check to see if the club 12 is in the correct position proximate the impact with the golf ball and during the follow-through. Thus, the indicia 40 on the grip 10 provides a quick, easy and effective device which allows golfers of all abilities to ensure the golf club 12 is correctly positioned during all different phases of the golf swing.

In the embodiment shown in FIGS. 10–13, the golfer 70 can look at the grip 10 during the different portions of the golf swing described above, but if the golfer 70 sees either the first line 64 or the second line 66 during the swing, this indicates to the golfer that the golf club 12 is not in the correct position. Thus, the golfer 70 can move the golf club 12 into the correct position such that neither lines 64 or 66 are visible to the golfer. Thus, in this embodiment, the indicia 62 warns the golfer 70 that the golf club 12 is not in the correct position.

The indicia 40, 50, and 62 preferably has a large color contrast with the other portion of the grip 10 so that the golfer can quickly and easily determine if the golf club 12 is in the correct location. For example, in the embodiment shown in FIGS. 1–9, the indicia 40 and 50 preferably comprises white lines while the remaining portion of the grip is black. Thus, if the golfer sees the white lines during the golf swing, this indicates the golf club is correctly position. In the embodiment shown in FIGS. 10–13, the indicia 62 is preferably red so that if the golfer sees red during the golf swing, this indicates the golf club is not in the correct position.

Although this invention has been described in terms of certain preferred embodiments, other embodiments apparent to those of ordinary skill in the art are also within the scope of this invention. Accordingly, the scope of the invention is intended to be defined only by the claims which follow.

I claim:

1. A golf club for use by a golfer, comprising:

an elongated shaft having a first end and a second end, the elongated shaft extending generally along a longitudinal axis;

a club head attached to the first end of the shaft;

a tubular body attached to the second end of the shaft, the tubular body having a first end, a second end, and extending along a longitudinal axis;

first indicia attached to the tubular body;

second indicia attached to the tubular body and spaced from the first indicia; and third indicia positioned between and generally interconnecting the first indicia and the second indicia;

wherein the golfer can see and use the first indica and second indicia to determine if the golf club is in the desired position during a golf swing and wherein the golfer can see and use the third indicia to position the golfer's hands during the golf swing.

2. The golf club of claim 1, wherein said first indicia comprises a first line extending along a first side of said tubular body and wherein said second indicia comprises a second line extending along a second side of said tubular body, wherein said first line and said second line are visible to the golfer during a golf swing to indicate that the golf club is in the desired position during the golf swing and wherein said first line or said second line is not visible during the golf swing to indicate that the golf club is not in the desired position.

3. The golf club of claim 1, wherein said first indicia comprises a first line extending generally from said first end of said elongated body towards said second end of said elongated body and said second indicia comprises a second line extending generally from said first end of said elongated body towards said second end of said elongated body, and wherein the first line is generally square to the leading edge of the golf club face and the second line is at an angle of at least 90° from the first line when viewed from the first end of the tubular body.

4. The golf club of claim 2, wherein said elongated tubular body is tapered from said second end to said first end, and wherein the distance between said first line and said second line increases from said first end towards said second end.

5. The golf club of claim 1, further comprising a horizontal axis located generally transverse to said longitudinal axis, wherein said horizontal axis divides said grip into a front side and a rear side, wherein said first indicia comprises a first line located on one side of said front side and wherein said second indicia comprises a second line located on another side of said front side.

6. The golf club of claim 1, wherein said first and second indicia includes an upper surface configured to be engaged by the hands of a golfer and a lower surface configured to be attached to said elongated body.

7. The golf club of claim 1, further comprising a horizontal axis located generally transverse to said longitudinal axis of the tubular body, wherein said horizontal axis divides said grip into a front side and a rear side, wherein said first indicia comprises a first line extending along a first side of said tubular body generally between about 0° and about 10° above said horizontal axis and wherein said second indicia comprises a second line extending along a second side of said tubular body generally between about 0° and about 10° above said horizontal axis.

8. The golf club of claim 1, wherein said first and second indicia indicates the correct positioning of the golfer's wrists and the correct position of the golf club during the golf swing.

9. The golf club of claim 1, wherein said third indicia is sized and configured to indicate desired positioning of the right hand of a right handed golfer or the left hand of a left handed golfer on said tubular body.

10. The golf club of claim 1, wherein the first indicia is positioned on a first side of the tubular body within about 30° of a horizontal axis when viewed from the first end of the tubular body and the second indicia is positioned within about 30° of the horizontal axis on a second side of the tubular body.

11. The golf club of claim 1, wherein said third indicia includes one or more generally V-shaped portions that are generally aligned along said longitudinal axis of said tubular body.

12. A tool configured to be attached to a golf club, the tool adapted to indicate whether the golf club is in the correct position during a golf swing, the tool, comprising:

a golf club grip including a first end and a second end; and indicia attached to said golf club grip, said indicia including a first line extending along a first side of said grip, a second line extending along a second side of said grip and a generally V-shaped portion positioned between said first line and said second line;

wherein the first line is spaced at least about 120° from the second line when viewed from the first end of the golf club grip.

13. The tool of claim 12, wherein said indicia includes a top surface and a bottom surface, said top surface configured to be engaged by the hands of a golfer and said bottom surface configured to attach said indicia to the golf club grip.

14. The tool of claim 12, further comprising a golf club with a shaft, said golf club grip attached to the shaft, and wherein said indicia indicates the correct position of the golf club during a golf swing.

15. The tool of claim 12, wherein said indicia is configured to be seen by a golfer during a golf swing to indicate that the golf club is in the correct position.

16. The tool of claim 12, wherein said indicia is configured to be seen by a golfer during a golf swing to indicate that the golf club is in the incorrect position.

17. A method for checking to see if a golf club is correctly positioned during a golf swing, comprising:

providing indicia having a top surface configured to be engaged by the hands of a golfer and a bottom surface configured to be attached to the golf club, said indicia including a first portion spaced at least about 120° from a second portion when viewed from the first end of the grip, said indicia including a third portion positioned generally between said first portion and said second portion, said third portion substantially interconnecting said first portion and said second portion, said third portion having a generally V-shaped configuration;

providing a golf club; and attaching saids indicia to the golf club in a location to indicate the correct position of the golf club during the golf swing.

18. The method of claim 17, further comprising the steps of gripping the golf club and looking to see if said indicia is visible during the golf swing.

19. The method of claim 17, further comprising the steps of gripping the golf club and looking to see if said first portion and said second portion of said indicia are visible during the golf swing.

20. A golf club for use by a golfer, comprising:

an elongated shaft including a first end and a second end;

a club head attached to the first end of the shaft;

a grip attached to the second end of the shaft, the grip including a first end and a second end; and indicia attached to the grip, the indicia including a first portion and a second portion which are visible to the golfer during a golf swing to indicate that the golf club is in the desired position, the indicia including a third portion generally interconnecting the first portion and the second portion, the third portion having a generally V-shaped configuration to indicate that the golfer's hands are in the correct position;

wherein the first portion and the second portion are spaced at least about 120° apart when viewed from the first end of the grip.

21. A golf club, comprising:

an elongated shaft having a first end and a second end;

a golf club head attached to the first end of the shaft;

a grip attached to the second end of the shaft, the grip having a first end and a second end, the grip extending generally along a longitudinal axis;

first indicia extending generally parallel to the longitudinal axis of the grip;

second indicia extending generally parallel to the longitudinal axis of the grip; and third indicia positioned between said first indicia and said second indicia, said third indicia having a generally V-shaped configuration;

wherein the first indicia is positioned generally between about 0° and about 30° above a horizontal axis when viewed from the first end of the grip and the second indicia is positioned generally between about 0° and about 30° above the horizontal axis when viewed from the first end of the grip.

22. The golf club of claim 21, wherein said third indicia includes a first line and a second line that are interconnected at an angle to form said generally V-shaped configuration.

23. The golf club of claim 21, wherein a golfer can see and use said third indicia to position a hand on said grip.

24. The golf club of claim 21, wherein said third indicia is sized and configured to be positioned between a thumb and a first finger of the right hand for a right handed golfer or the left hand for a left handed golfer to indicate that said grip is being held in a desired position.

25. The golf club of claim 21, wherein said third indicia substantially interconnects said first indicia and said second indicia.

26. The golf club of claim 21, wherein said third indicia includes a plurality of generally V-shaped configurations that are generally aligned along said longitudinal axis of said grip.

27. A tool configured to be attached to a golf club, the tool adapted to indicate whether the golf club is in the correct position during a golf swing, the tool comprising:

a golf grip including an elongated body having an inner surface configured to be attached to the golf club and an outer surface configured to be engaged by the hands of a golfer;

first indicia extending from a first end of the grip towards a second end of said grip;

second indicia extending from said first end of said grip towards said second end of said grip; and third indicia positioned between said first indicia and said second indicia, said third indicia including one or more generally V-shaped portions which substantially interconnect said first indicia and said second indicia;

wherein said first indicia and said second indicia are visible during a golf swing to indicate that the golf club is in the desired position during the golf swing and wherein the first indicia or the second indicia is not visible if the golf club is not correctly positioned during the golf swing.

* * * * *

UNITED STATES PATENT AND TRADEMARK OFFICE

CERTIFICATE OF CORRECTION

PATENT NO. : 6,022,278
DATED : February 8, 2000
INVENTOR(S) : Al J. Vela

It is certified that error appears in the above-identified patent and that said Letters Patent is hereby corrected as shown below:

Column 1:
Line 45, after "a" delete the period

Column 2:
Line 23, after, "is" insert --that--
Line 66, after "is" insert --that--

Column 3:
Line 12, after "be" change "position" to --positioned--

Column 5:
Line 4, after "such" insert --that--

Signed and Sealed this

Twelfth Day of June, 2001

Nicholas P. Godici

*Attest:*

*Attesting Officer*

NICHOLAS P. GODICI
*Acting Director of the United States Patent and Trademark Office*